United States Patent [19]

Perkins

[11] Patent Number: 4,768,592

[45] Date of Patent: Sep. 6, 1988

[54] ENHANCED OIL RECOVERY PROCESS

[75] Inventor: Thomas K. Perkins, Dallas, Tex.

[73] Assignee: Atlantic Richfield Company, Los Angeles, Calif.

[21] Appl. No.: 62,314

[22] Filed: Jun. 3, 1987

Related U.S. Application Data

[63] Continuation of Ser. No. 855,536, Apr. 23, 1986, abandoned.

[51] Int. Cl.[4] ..... E21B 33/138; E21B 43/22

[52] U.S. Cl. ..... 166/275; 166/294

[58] Field of Search ..... 166/269, 273, 274, 275, 166/294; 252/8.554

[56] References Cited

U.S. PATENT DOCUMENTS

| | | | |
|---|---|---|---|
| 2,090,626 | 8/1937 | Grebe | 166/294 |
| 2,341,500 | 2/1944 | Detling et al. | 252/8.554 X |
| 2,875,831 | 3/1959 | Martin et al. | 166/275 X |
| 3,529,668 | 9/1970 | Bernard | 166/275 X |
| 3,817,331 | 6/1974 | Jones | 166/275 |
| 3,847,823 | 11/1974 | Clark et al. | 252/8.554 |
| 4,044,831 | 8/1977 | Allen | 252/8.554 X |
| 4,085,800 | 4/1978 | Engle et al. | 166/294 X |
| 4,159,037 | 6/1979 | Varnon et al. | 166/294 X |
| 4,323,463 | 4/1982 | Morduchowitz | 166/275 X |
| 4,448,697 | 5/1984 | McCoy et al. | 252/8.554 |
| 4,501,673 | 2/1985 | Hodgson | 252/8.554 |
| 4,556,495 | 12/1985 | Shaw | 252/8.554 |

OTHER PUBLICATIONS

Pirson, Sylvain J., *Oil Reservoir Engineering*, second edition, McGraw-Hill Book Company, Inc., 1958, pp. 68–75.

*Primary Examiner*—George A. Suchfield

*Attorney, Agent, or Firm*—Michael E. Martin; Frank J. Uxa

[57] ABSTRACT

A process for recovery of hydrocarbons from a porous reservoir comprising injecting substantially simultaneously into the reservoir a gas and an aqueous liquid including at least one surface active agent present in an amount up to about 50 percent of the critical micellar concentration such that menisci are formed in certain ones of the pore spaces of the reservoir to an extent that oil droplets lodged in others of the pore spaces are swept by the injected mixture toward a production well.

2 Claims, 1 Drawing Sheet

ENHANCED OIL RECOVERY PROCESS

CROSS REFERENCE TO RELATED APPLICATION

This application is a continuation of application Ser. No. 855,536, filed Apr. 23, 1986, now abandoned.

BACKGROUND OF THE INVENTION

1. Field of the Invention

This invention relates to an improved process for recovery of hydrocarbons from a porous reservoir. More particularly, the invention relates to an improved enhanced oil recovery process for recovery of hydrocarbons from a porous reservoir which involves injecting a material into the reservoir.

2. Background

A large portion of the original oil in place in many oil-bearing subterranean formations remains in place after primary production and water flooding. As oil reserves dwindle and exploration for new discoveries becomes more difficult and costly, the use of enhanced oil recovery techniques on previously discovered resources will play an increasingly important role in the overall production of crude petroleum.

Because of the porous nature of oil-bearing formations or reservoirs, the formation itself exerts capillary forces on the contained oil. Viscous forces are also exerted on the oil in the formation. Studies have shown that, for immiscible displacement EOR techniques such as waterflooding, as the ratio of capillary to viscous forces decreases the fraction of oil recovered increases.

There are three generic types of enhanced oil recovery (EOR) processing generally recognized in the industry. The first of these is thermal processing, e.g., steam soak, steam drive, in-situ combustion, to reduce the viscosity of heavy, highly viscous oils, and thereby increase oil recovery.

A second EOR technique is miscible flooding. Various materials miscible in the residual crude oil have been suggested for injection into the porous formation or reservoir in an attempt to increase the production of crude oil. Such materials have included liquified petroleum gas (LPG), propane and carbon dioxide. For miscible flooding processes, the ratio of capillary to viscous forces is zero and 100% residual oil recovery is theoretically possible. However, miscible flooding is a relatively expensive and high risk EOR technique. For example, the relative price of LPG and propane to crude petroleum may make the use of these solvents economically prohibitive. Substantial capital may be required to produce carbon dioxide and/or transport carbon dioxide to the well site. Also, the amount of oil that can be recovered using these miscible flooding techniques is dependent on the type of crude petroleum to be recovered and even on the configuration and condition of the individual porous reservoir involved. Miscible flooding may work extremely well in one situation and have no substantial effect in another instance. Hence, miscible flooding is a high risk EOR technique.

A third EOR processing option involves the use of micellar/polymer fluids. These fluids are typically aqueous solutions which contain surfactants at relatively high concentrations above the critical micellar value and polymers, such as polysaccharides and hydrolyzed polyacrylamides, that develop aqueous phase viscosities that provide stable displacement with reduced bypassing. For micellar processes, the interfacial forces are reduced sufficiently to approach a miscible-like displacement, i.e., oil recoveries approaching 100% are theoretically possible. Field experience with the technique has been generally disappointing. This performance can be traced back to the fact that because of the cost of these systems, the micellar/polymer fluids can be injected only in slugs, rather than continuously, if economic recovery of crude oil is to be achieved. The slug size is generally limited to less than 5–10% of the reservoir pore volume. Also, the integrity of the slug is weakened by numerous factors, such as temperature and shear degradation, precipitation by ions occurring in the connate water or released by ion exchange with the reservoir clays, adsorption on mineral surfaces, cross-flow and diffusion into low permeability layers, and transfer of the active surfactants into the oil phase. In short, the relatively expensive micellar/polymer fluids are often not cost effective as EOR agents.

The use of surfactants during ordinary waterflooding decreases the capillary to viscous forces ratio to some extent, however, generally not enough to substantially increase oil recovery. In any event, an improved enhanced oil recovery process would clearly be advantageous.

SUMMARY OF THE INVENTION

One object of the present invention is to provide a process for recovery of hydrocarbons from a porous reservoir.

Another object of the present invention is to provide an improved enhanced oil recovery process for recovery of crude petroleum from a porous reservoir.

In one broad aspect, the present improvement comprises: using as the injected material an admixture comprising a gaseous medium, an aqueous liquid medium, and at least one surface active agent in an amount effective to reduce the ratio of capillary forces to viscous forces in the reservoir. In another broad embodiment, the present improvement comprises; injecting into the porous reservoir, substantially simultaneously, a gaseous medium, an aqueous liquid medium and at least one surface active agent in an amount effective to reduce the ratio of capillary forces to viscous forces in the reservoir.

The present invention further provides a process for recovery of hydrocarbons from a porous reservoir comprising injecting substantially simultaneously into the reservoir a gaseous medium selected from the group consisting of methane, ethane, natural gas, nitrogen, combustion flue gases, carbon dioxide and mixtures thereof, and a mixture of an aqueous liquid medium and at least one surface active agent in an amount in the range of about 0.1% to about 50% of the critical micellar concentration of said surface active agent in said aqueous medium and such as to form menisci in certain ones of the pore spaces of the reservoir to an extent that hydrocarbons lodged in other pore spaces of the reservoir are swept by the injected substances toward a production well for recovery.

The present process has been found to provide for recovery of hydrocarbons, e.g. crude petroleum, from porous formations. This improved EOR process is relatively inexpensive and cost effective for hydrocarbon recovery. For example, a wide variety of gases may be used as the gaseous medium; water or brine may be used as the aqueous liquid medium; and any suitable surface active agent or combination of surface active agents may be employed. In general, the amount or concentration of the surface active agent used in the present process (calculated as a fraction of the aqueous liquid medium) is reduced relative to the concentration of the surfactant in the conventional micellar/polymer fluids, discussed previously. Thus, the economic investment and risk in using the present process are substantially reduced relative to using the more expensive miscible materials or the micellar/polymer fluids.

In one preferred embodiment, the displacement caused by the present gaseous medium, aqueous medium and surface active agent is substantially immiscible. In this embodiment, there need be no concern for the possible loss of miscibility or for maintaining a certain pressure to maintain miscibility. The present process provides improved mobility control of the injected material to improve sweep efficiency.

DESCRIPTION OF A PREFERRED EMBODIMENT

As opposed to processes employing micellar/-polymer fluids, the chemicals, e.g., surface active agents, employed in the present process, contrary to the micellar/polymer fluid processes, involves no large front end chemical investment that would significantly reduce economic potential and increase risk. In one preferred embodiment, the presently useful material, e.g., injected material, is substantially free of added polymeric components, such as polysaccharides, hydrolyzed polyacrylamides and functional equivalents. The present gaseous medium/aqueous liquid medium/surface active agent system is sufficiently stable at high reservoir temperatures without added high temperature polymers needed in high temperature applications of processes employing micellar/polymer fluids. This embodiment provides for still further cost effectiveness in practicing the present process. Preferably, the present admixture of gaseous medium/liquid aqueous medium/-surface active agent is injected into the reservoir substantially continuously. This is contrary to the micellar/polymer fluid EOR processing in which discontinuous slugs of the fluid are injected. The preferred continuous injection of the presently useful admixture is not only cost effective, but also provides a constancy and uniformity of sweep through the reservoir which results in improved hydrocarbon recovery effectiveness.

Figure 2:
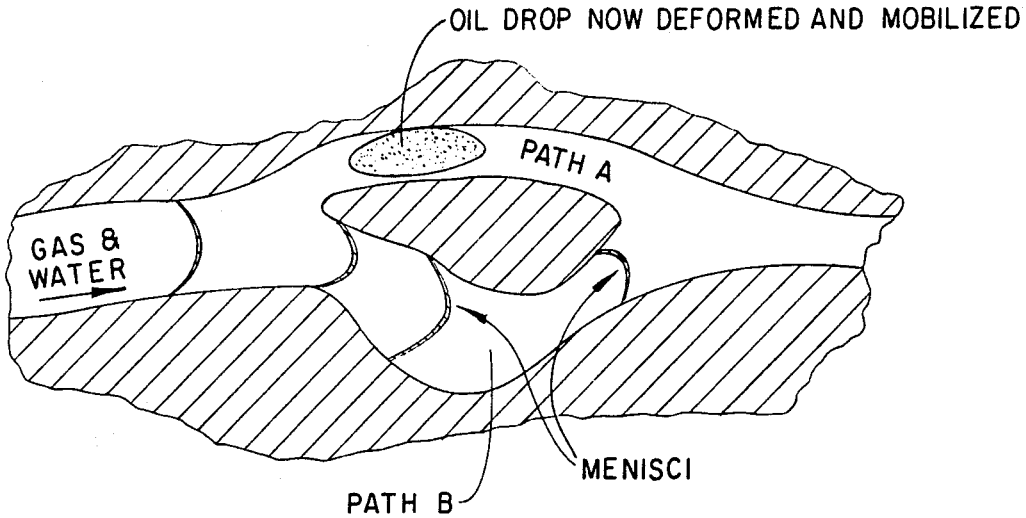
FIG. 2 is a diagram illustrating the process of the present invention.

The present admixture comprising a gaseous medium, an aqueous liquid medium and at least one surface active agent preferably acts to increase the formation of menisci in the pore spaces or pores of the reservoir, as illustrated in FIG. 2. These menisci, in turn, act as blocks to the sweep of the admixture through the reservoir and, therefore, increased pressure or force is exerted on the hydrocarbons in the pores to be displaced and swept from the pores of the reservoir toward a production well for recovery.

The liquid aqueous medium may be any such medium suitable to perform in the present process. Because of cost and availability considerations, it is preferred that the liquid aqueous medium be water, more preferably sea water or brine. The aqueous liquid medium may also include one or more components, e.g., caustic materials, useful for the in situ production of the presently useful surface active agents and/or useful to improve the effectiveness of the presently useful surface active agents.

Any suitable gaseous medium may be used in the present process. It is preferred that the gaseous medium form a separate phase from the aqueous liquid medium at the conditions present in the porous reservoir. For example, the gaseous medium can be substantially insoluble (or have a relatively low saturation level) in the aqueous liquid medium at the conditions present in the reservoir.

Preferably, the gaseous medium is selected from the group consisting of methane, ethane, natural gas, nitrogen, combustion flue gas, carbon dioxide and mixtures thereof. The choice of a specific gaseous medium for use in the present invention depends on various factors, for example, the aqueous liquid medium and surface active agent being used, and the specific reservoir and reservoir conditions to be encountered. Because of availability and cost considerations, the more preferred gaseous medium for use in the present invention is selected from the group consisting of methane, ethane, natural gas and mixtures thereof. In certain situations, low pressure nitrogen performs in the present invention at least as well as natural gas. The use of nitrogen in the past has typically been at very high pressures to provide nitrogen-hydrocarbon miscibility. The present EOR process can function very satisfactorily without requiring hydrocarbon miscibility. In those instances where nitrogen can be effectively used, the natural gas and its components, which are not needed for EOR can be sold. If combustion flue gases are to be used as the gaseous medium, a limited amount of natural gas (or its components) or crude petroleum (or its components) can be used to generate the gas for injection and thereby avoid injecting oxygen. The power generated from this combustion can be used to operate the EOR process, and the carbon dioxide generated acts to swell the oil and to further improve hydrocarbon recovery.

The surface active agent may be selected from those surface active agents useful in other EOR processing, such as EOR processing involving the use of micellar/-polymer fluids. However, the concentration of the surface active agent or agents as a percent or fraction of the present liquid aqueous medium is less than the critical micellar concentration of such agents found in conventional micellar/polymer fluids. Preferably, the concentration of the surface active agent or agents in the present liquid aqueous medium is in the range of about 0.1% to about 50%, more preferably about 0.5% to about 10%, of the critical micellar/polymer fluid composition.

The specific surface active agent or combination or such agents and the specific amount of such agent or agents employed will vary widely and be dependent on many factors. For example, in choosing which agent or agents to use, consideration should be given to the gaseous and liquid aqueous media being employed, the specific reservoir and reservoir conditions to be encountered, and the properties of the hydrocarbon to be recovered. Included among the surface active agents which can be employed in the present process are alkyl pyridinium salts, fatty acid sulfates of alkali and alkaline earth metals, sulfonates (including overbased sulfonates), of alkali and alkaline earth metals, glycosides, fatty acid salts of alkali and alkaline earth metals, quaternary ammonium salts and the like and mixtures thereof.

The surface active agent or agents may be injected into the reservoir as a separate stream and/or combined with, e.g., dissolved in the liquid aqueous medium, and/or produced in situ in the reservoir after the gaseous and liquid aqueous media have been injected. To provide for ease of injection and for improved control as to the amount of surface active agent present in the reservoir, it is preferred that the surface active agent or agents be combined with the liquid aqueous medium prior to injection.

The various components of the present system, e.g., the gaseous medium, the liquid aqueous medium and the surface active agent, may be injected in any sequence into the reservoir. Preferably, the injection is on a continuous basis, e.g., continuous repetition of the injection sequence, to provide for a more effective sweep through the reservoir. To provide improved sweep control and effectiveness, it is more preferred that the gaseous medium, liquid aqueous medium and surfact active agent be injected into the reservoir substantially simultaneously, still more preferably substantially continuously.

The following non-limiting example illustrates certain of the aspects and advantages of the present invention.

EXAMPLE

A crude petroleum-bearing, porous reservoir is produced, using conventional primary recovery methods, until is is determined that enhanced oil recovery is needed to effectively and economically produce the reservoir further. Injection wells into the reservoir are strategically located, in a conventional manner, relative to the producing wells so that fluid injected in the injection wells would tend to sweep crude petroleum remaining in the reservoir toward the production wells for recovery.

Figure 1:
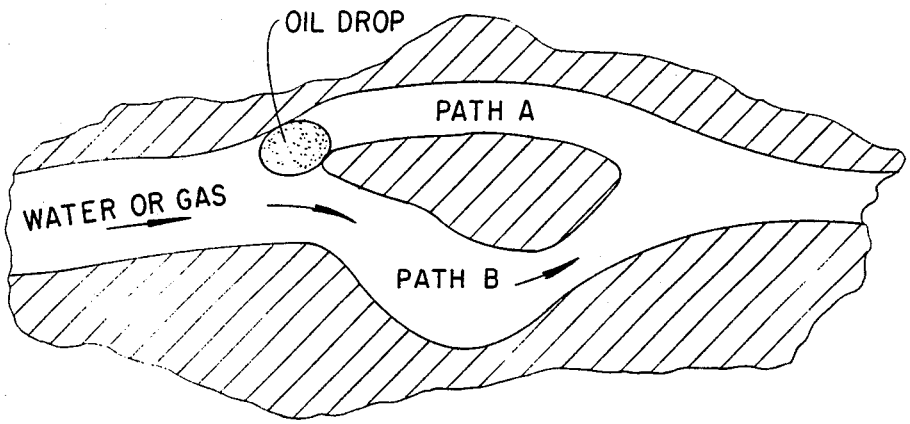
FIG. 1 is a diagram of a porous reservoir showing how injected water or gas may bypass in place oil.

Seawater (brine) is injected into the reservoir through the injection wells. A quantity of crude petroleum is recovered although some oil in place is bypassed by the injected fluids as illustrated in FIG. 1. This waterflood/crude petroleum recovery continues until it is determined that additional enhanced oil recovery is needed to effectively and economically produce the reservoir further.

A combination of brine and about 0.1% by weight (based on the total combination) of sodium oleate (as a surface active agent) is prepared. This combination and natural gas are injected substantially simultaneously and continuously into each of the injection wells, in amounts so that three (3) volumes of natural gas are injected for each volume of the combination injected. A quantity of crude petroleum is economically recovered by the improved process as illustrated in FIG. 2 and which is substantially equal to the quantity of crude petroleum recovered in response to waterflooding the reservoir.

The use of the present EOR process does not require that the porous reservoir be previously waterflooded or subjected to any other EOR process. Good results are obtained if the present process is used on a reservoir directly after primary recovery methods are used. In certain situations, the present process may be employed without first using such primary production techniques.

While this invention has been described with respect to various specific examples and embodiments, it is to be understood that the invention is not limited thereto and that it can be variously practiced within the scope of the following claims.

What I claim is:

1. A process for recovery of hydrocarbons from a porous reservoir comprising:

injecting into said reservoir through an injection well substantially simultaneously a gaseous medium selected from the group consisting of methane, ethane, natural gas, nitrogen, combustion flue gases, carbon dioxide and mixtures thereof, and a mixture of an aqueous liquid medium and at least one surface active agent in an amount in the range of about 0.1% to about 50% of the critical micellar concentration of said surface active agent in said aqueous medium, said concentration of said surface active agent being such as to form menisci in certain ones of the pore spaces of said reservoir to an extent that hydrocarbons lodged in others of the pore spaces of said reservoir are swept by the injected substances toward a production well for recovery.

2. The process of claim 1 wherein said surface active agent is selected from the group consisting of alkyl pyridinium salts, fatty acid sulfates of alkali and alkaline earth metals, sulfonates and overbased sulfonates of alkali and alkaline earth metals, glycosides, fatty acid salts of alkali and alkaline earth metals, quaternary ammonium salts and mixtures thereof.

* * * * *